United States Patent [19]

Korger

[11] 4,062,554

[45] Dec. 13, 1977

[54] SKI STICK

[75] Inventor: Heinz Korger, Munich, Germany

[73] Assignee: Hannes Marker, Garmisch-Partenkirchen, Germany

[21] Appl. No.: 665,877

[22] Filed: Mar. 11, 1976

[30] Foreign Application Priority Data

Mar. 11, 1975 Germany ..... 2510608

[51] Int. Cl.[2] ..... A63C 11/22

[52] U.S. Cl. ..... 280/11.37 D

[58] Field of Search ..... 280/11.37 D, 11.37 L, 280/11.37 H, 11.37 B, 11.37 F, 11.37 N, 11.37 E

[56] References Cited

U.S. PATENT DOCUMENTS

| | | | |
|---|---|---|---|
| 3,085,814 | 4/1963 | Scott | 280/11.37 H |

FOREIGN PATENT DOCUMENTS

| | | | |
|---|---|---|---|
| 178,317 | 4/1954 | Austria | 280/11.37 L |
| 1,369,228 | 6/1964 | France | 280/11.37 H |
| 98,588 | 4/1940 | Sweden | 280/11.37 D |

*Primary Examiner*—Joseph F. Peters, Jr.
*Assistant Examiner*—Milton L. Smith
*Attorney, Agent, or Firm*—Fleit & Jacobson

[57] ABSTRACT

A ski stick comprising a tubular shank having a handle near one end is provided with an impact surface formed by an extension of said stick extending at an acute angle to the longitudinal axis of said shank and intersecting same.

7 Claims, 2 Drawing Figures

SKI STICK

The invention relates to a ski stick comprising a tubular shank with a handle near the top and a tip at the bottom, wherein the upper end of the shank is enlarged to form an impact surface which is larger than the cross-section of the handle in the region where the latter is grasped.

In known ski sticks of this kind, a buffer at the free end of the handle forms the impact surface. In the case of a fall by the skier, the buffer serves to keep the surface loading of the ski stick in the longitudinal direction of the latter to as low a value as possible. The buffer is generally made from elastic material and is intended resiliently to absorb the forces exerted thereon. For constructional reasons, the possibility of shock absorption in this manner is relatively small. In addition, the ski stick is in practice subjected to static loading in the longitudinal direction when the skier falls on the stick. To minimise the danger of injury to the skier, the cross-section of the ski stick is designed so that it will buckle when a correspondingly high force is applied. However, such buckling is generally not resilient, i.e. the stick becomes irrepairably damaged.

Destruction of the stick on the occurrence of an excessive load has already been avoided in another known embodiment, where the stick is made from a plurality of tube sections which can be telescoped one within the other. Telescopic internesting of the tube sections is normally prevented by locking elements provided in the interior. Up to a predetermined load on the ski stick in the longitudinal direction thereof, the locking elements ensure secure interconnection of the tube sections in their extended position. After the tube sections have been telescoped, which can also be effected by intentionally releasing the locking elements for the purpose of storage or transport in the least possible space, the ski stick can be extended again, the locking elements automatically assuming their operative positions.

However, in practice, this known telescopic ski stick has not proved popular, probably because it is complicated to make and therefore expensive and also because it is heavy and possesses a centre of gravity that is inconveniently located and therefore makes the ski stick inconvenient to handle.

It is therefore an object of the present invention to provide an improved ski stick shaped so as practically to eleminate the danger of injury to a skier when he falls on the stick, but without involving a costly construction.

According to the invention, the aforementioned impact surface is constituted by an extension of the stick extending at an acute angle to the longitudinal axis of the shank and intersecting same. This construction permits the ski stick to be used in conventional manner in so far that, during normal skiing, forces are exerted through the handle to the shank of the stick in the longitudinal direction thereof. However, such a force cannot be exerted on the tubular shank if the body of the skier happens to fall on the ski stick. If the tip of the ski stick is embedded in the ground, a force exerted on the extension coaxially to the tubular shank is divided up into force components which ensure that the shank is no longer exclusively subjected to compression loading. More particularly, the tubular shank will now be loaded in bending, regardless of whether the applied force is coaxial with the tubular shank of parallel to its axis. Consequently, the body of the skier effectively forces the ski stick to deflect laterally. Only in extremely rare cases will there be some slight compression loading on the tubular shank in the longitudinal direction thereof and this can be absorbed by a small amount of resilient flexure of the shank.

Since the ski stick according to the invention no longer makes predominant use of the buckling quality as the safety factor, the tubular shank need no longer have an extremely small cross-section. Accordingly, the danger of damage to the ski stick occasioned by a low resistance to bending is avoided by the invention. At the same time, the ski stick according to the invention will not be subjected to unpleasant flexing during use.

Two examples of the invention will now be described with reference to the accompanying drawings, wherein.

Figure 1:
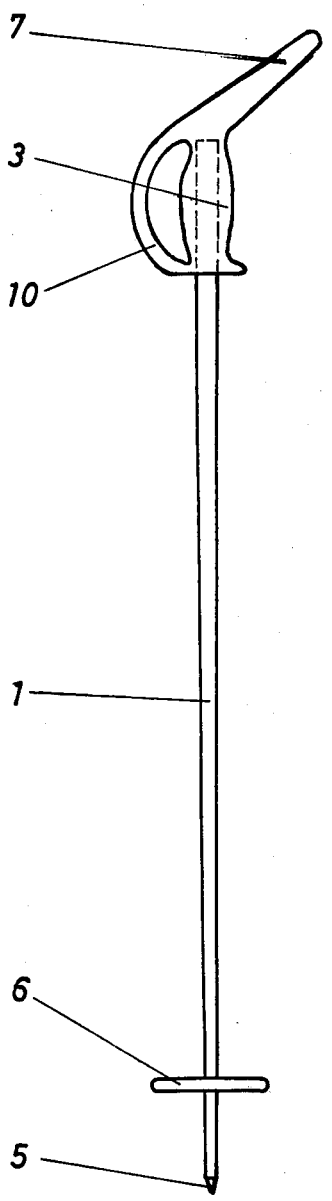
FIG. 1 is a side elevation of a ski stick.

In both illustrated embodiments, the tubular shank 1 or 2 carries a handle 3 or 4, respectively, near the top. At the bottom, the shank has a tip 5 and, intermediate its length, a so-called snow plate 6.

According to the invention, an impact surface which, if the skier happens to fall on the stick, is to minimise the danger of injury, is formed by an extension 7 or 8, respectively, of the ski stick beyond the portion of the handle that is grasped. This extension extends at an acute angle to the longitudinal axis of the tubular shank and intersects same. The preferred angle is substantially 45°.

Figure 2:
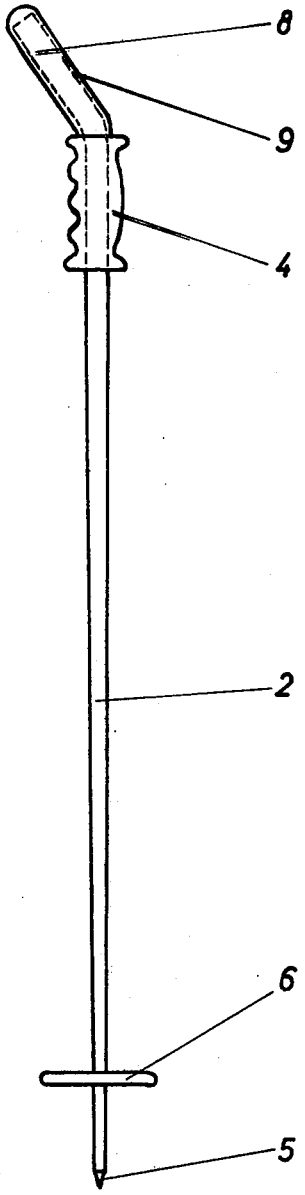
FIG. 2 is a side elevation of a further embodiment.

In the case of the FIG. 1 embodiment, the extension 7 is made in one piece with the handle 3, whereas in FIG. 2 the extension 8 is made in one piece with the tubular shank 2. FIG. 2 also shows that a plastic sleeve 9 may be provided to cover the open end of the extension 8, especially if the tubular shank is made of metal.

In both embodiments, the length of the extension 7 or 8 is chosen to be at least the same as the length of the handle portion that is grasped. The drawings show that it is basically immaterial whether the extension points in the skiing direction (as in FIG. 2) or against the skiing direction (as in FIG. 1). What is important is that an impact surface is avoided that is normal to the longitudinal axis of the shank or substantially normal thereto.

By reason of the invention, a force exerted on the ski stick by the body of the skier in the case of a fall is practically no longer exerted on the stick as a purely axial compressive force. If the tip of the ski stick is embedded in the ground, a force exerted on the extension coaxially with the tubular shank is resolved into components such that one substantial force component is applied to a lever arm and tends to swing the ski stick aside about the tip 5 acting as a fulcrum. This effect is intensified if the force on the stick is exerted in a direction parallel to the axis of the tubular shank rather than coaxially therewith. Thus, there is practically no danger of a skier becoming impaled on the ski stick in the case of a fall.

In the case of the FIG. 1 embodiment, the said handle 3 is in the form of a sword handle having an arched portion 10 which merges with the extension 7.

I claim:

1. A ski stick comprising a tubular shank having a tip at one end, gripping means comprising a handle mounted adjacent the other end of said tubular shank, impact surface means positioned above the gripping means for diverting forces from being exerted solely along the tubular shank direction, said impact surface means comprising an elongated extension, said elongated extension extending from the end of the handle remote from the tip of the tubular shaft, and angularly disposed at an acute angle relative to the handle and relative to the longitudinal axis of said tubular shank, said elongated extension having a length at least the same length as the handle.

2. A ski stick according to claim 1, wherein said extension is made in one piece with said handle.

3. A ski stick as claimed in claim 2 wherein said handle has finger protection means comprising an arched portion extending from one end of the handle to the other end of the handle, and merging with said elongated extension.

4. A ski stick according to claim 1, wherein said extension is made in one piece with said shank.

5. A ski stick according to claim 4, wherein said shank is of metal and said extension is covered by a plastic sleeve.

6. A ski stick according to claim 1, wherein said acute angle is substantially 45°.

7. A ski stick as claimed in claim 1 wherein said handle is elongated, the longitudinal axis of said handle extends along the elongated direction of said tubular shaft, and wherein said tubular shaft is straight.

* * * * *